US005380258A

United States Patent [19]

Hawley, Jr.

[11] Patent Number: 5,380,258

[45] Date of Patent: * Jan. 10, 1995

[54] EXERCISE APPARATUS

[75] Inventor: Peter J. Hawley, Jr., Brighton, Mass.

[73] Assignee: Stairmaster Sports/Medical Products, Inc., Kirkland, Wash.

[ * ] Notice: The portion of the term of this patent subsequent to Oct. 29, 2008 has been disclaimed.

[21] Appl. No.: 966,710

[22] Filed: Oct. 26, 1992

[51] Int. Cl.[6] ..... A63B 7/04

[52] U.S. Cl. ..... 482/37; 482/92; 482/93; 482/114; 482/120

[58] Field of Search ..... 482/37, 92, 93, 114, 482/115, 119, 120, 148

[56] References Cited

U.S. PATENT DOCUMENTS

| | | | |
|---|---|---|---|
| 3,445,108 | 5/1969 | Fenner et al. | 272/60 |
| 3,599,974 | 8/1971 | Price | 272/79 R |
| 3,782,718 | 1/1974 | Saylor | 273/60 |
| 3,794,316 | 2/1974 | Toman | 272/60 |
| 4,199,139 | 4/1980 | Mahnke et al. | 272/118 |
| 4,512,570 | 4/1985 | Tardivel | 272/112 |
| 4,709,919 | 12/1987 | Cano | 272/117 |
| 4,775,146 | 10/1988 | Stankovic | 482/93 |
| 4,842,268 | 6/1989 | Jenkins | 272/73 |
| 4,921,244 | 5/1990 | Berroth | 272/117 |
| 5,060,938 | 10/1991 | Hawley, Jr. | 482/37 |

FOREIGN PATENT DOCUMENTS

| | | | |
|---|---|---|---|
| 1430040 | 10/1988 | U.S.S.R. | 482/37 |

*Primary Examiner*—Stephen R. Crow
*Attorney, Agent, or Firm*—Seed and Berry

[57] ABSTRACT

Rope climbing apparatus comprises a support, a length of rope and a rope accumulator supported by the support for storing a variable length of rope. The accumulator includes a dancer trolley and means for force-loading the dancer trolley to a maximum storage position. A segment of rope is presented to a user of the apparatus so that he can draw rope from the accumulator. Variable drag mechanism supported by the support feeds rope pulled by the user back to the accumulator to replenish the accumulator. The drag mechanism inhibits the feeding of rope to the accumulator unless the rope is pulled with a force sufficient to overcome the force-loading on the accumulator dancer trolley and move the dancer from its maximum storage position. The drag mechanism also controls the rate at which rope is fed to the accumulator in accordance with the magnitude of the accumulator force-loading.

61 Claims, 1 Drawing Sheet

EXERCISE APPARATUS

TECHNICAL FIELD

This invention relates to an exercise apparatus and a method of exercising using the apparatus. It relates more particularly to such apparatus that enables the user to simulate climbing a rope.

BACKGROUND OF THE INVENTION

Rope climbing is a very effective form of exercise because it maintains the climber's arm and back muscles under dynamic tension. In other words, the climber's muscles are subjected to a pulling force due to part or all of the climber's weight as he supports himself on the rope whether or not he is moving up or down the rope. Superimposed on that force is an acceleration component which manifests itself when the climber pulls himself up or lowers himself down on the rope. Placing one's body under dynamic tension of this type improves one's muscle tone, blood circulation, respiration and general mental and physical fitness.

Rope climbing may be practiced as an exercise in and of itself or as part of training for mountain or rock climbing.

There have been some efforts to make exercise machines to simulate the act of climbing a rope. Usually these machines require the user to pull down on a rope hand-over-hand, with the rope passing through some kind of friction or drag mechanism that offers resistance to the pulling motion. One example of such exercise apparatus is disclosed in U.S. Pat. No. 4,512,570. The trouble with this type of apparatus is that it really does not simulate accurately the act of rope climbing which, as noted previously, subjects the arms to dynamic tension whether or not the climber is moving up or down on the rope. In the existing rope climbing exercise machines of which I am aware, no attempt is made to simulate the effect of the user's weight. In other words, no opposing force is exerted on the rope unless the user is actually accelerating the rope. Therefore, the user's muscles are not maintained under more or less constant tension as he pulls down on the rope, hand-over-hand. Rather, the force exerted on each arm varies from some maximum value at the top of each pulling motion to near zero at the bottom of the stroke. Such variable or intermittent tensioning of the body muscles is not as effective as constant dynamic tension in conditioning the body.

Also, prior exercise machines of this general type have tended to be fairly large and complicated pieces of machinery which take up a large amount of floor space and are relatively expensive to make.

SUMMARY OF THE INVENTION

Accordingly, the present invention aims to provide an exercise apparatus which more closely simulates the activity of rope climbing than do prior machines of this general type.

Another object of the invention is to provide a rope climbing exercise machine which can exert a more or less constant opposing force on one's body when one uses the machine.

A further object of the invention is to provide a rope climbing exercise apparatus which is adjustable to accommodate users whose strengths vary over a relatively wide range.

Another object of the invention is to provide an exercise apparatus of this general type which is relatively compact and which requires a relatively small amount of floor space.

Still another object of the invention is to provide a rope climbing exercise apparatus which is composed of relatively few components which are easy and inexpensive to fabricate.

Other objects will in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, my exercise apparatus comprises an upstanding frame which supports a system of pulleys around which the rope is trained to form an endless loop. The loop includes a vertical stretch of rope situated at one end of the frame which one can grasp and pull down in hand-over-hand fashion to simulate climbing the rope. Preferably, a seat is located adjacent to that end of the frame on which the user may sit while he or she is exercising.

The apparatus includes a rope accumulator in the form of a pair of fixed pulleys rotatably mounted to the frame and a force-loaded movable dancer pulley around which the rope is looped so that the accumulator can store a variable length of rope. The dancer pulley is urged to its maximum storage position by a stack of weights which normally rests on one end of a generally horizontal teeterboard pivotally mounted to the frame. The teeterboard is more than balanced by a spring acting between the opposite end of the teeterboard and the frame. When the user pulls down on the vertical stretch of rope, rope is drawn from the accumulator. The rope at the bottom of the stretch being pulled is recirculated back into the accumulator by way of a variable drag mechanism.

The drag mechanism includes a relatively large diameter circular drum or wheel which is rotatively supported by the frame directly above the spring end of the teeterboard. The drum or wheel has three circumferential grooves so that it constitutes in effect three pulleys which rotate in unison. The rope at the bottom of the stretch being pulled by the user is conducted to one of these grooves so that a segment of the rope is trained around the drum on its way back to the accumulator. A second one of the drum grooves accommodates a non-extensible strap whose ends extend from the drum and are secured to the spring end of the teeterboard. This strap exerts a constant frictional braking force on the drum which is proportional to the amount of weight lifted from the teeterboard by the accumulator dancer when the user pulls down on the rope while performing a rope climbing exercise. The greater the amount of weight lifted from the teeterboard, the greater the drag exerted on the drum.

The third groove in the drum accommodates a second inextensible strap that is engaged around the drum. One end of that second strap is connected to the apparatus frame at a location below the spring end of the teeterboard. The other end of that belt is connected to a lever arm, one end of which is pivotally mounted to the frame so that the arm can swing toward and away from the drum. The opposite or free end of that lever arm is linked to the accumulator dancer pulley so that when the dancer pulley is moved from its maximum toward its minimum storage position the lever arm is swung about its pivot to reduce the tension on the second strap trained around the rotary drum, and vice versa. This change in strap tension varies the drag exerted on the drum by the second strap. The coefficient of friction of the second strap and the tension exerted on that strap through the lever arm are selected so that the drum will not turn unless the dancer pulley is moved from its maximum storage position by the user pulling on the rope.

Before he starts to exercise, the user selects the amount of weight to be lifted. Then he starts pulling the rope down hand-over-hand. Assuming that he pulls with enough force to lift the selected amount of weight from the teeterboard, the dancer will move from its maximum storage position and, in so doing, move the lever arm to untension the second strap, thereby allowing the drag mechanize, i.e., the drum, to recirculate rope to replenish the accumulator.

As will be seen presently, the accumulator and variable drag mechanism combine to oppose the pulling force on the rope in such a way that the user feels as he would if he were actually climbing the rope. In other words, the forces exerted on the user's arm and back muscles via the rope are more or less the same as would be exerted if the user were supporting part or all of his own weight while hanging from a rope or moving up or down the rope. The exercise apparatus thus provides a much more effective and realistic climbing experience than is provided by comparable conventional machines of this general type which exert intermittent or variable drag forces on the rope to oppose the hand-over-hand downward pulling motions of the user.

As will be seen presently, my exercise apparatus is composed of relatively few simple parts that are easy to fabricate and to assemble. Moreover, the apparatus is quite compact so that it can fit easily in a relatively small exercise room or space. Therefore, the apparatus should be a welcome addition to any gym, health club or the like.

The present invention resides in an exercise apparatus using a resistance member applying a resistance force in a first direction. In the illustrated embodiment of the invention, the resistance force is supplied by a vertically movable weight. The apparatus further includes a connector member to which the resistance force is applied. An input mechanism is engaged by the user to input an exercise force at a user-selected velocity to apply a positive input power. In the illustrated embodiment, the input mechanism includes a flexible member such as a rope to which a unidirectional input force is applied by the user which tends to lift the weight.

The apparatus further includes a brake applying a negative braking power. In the illustrated embodiment of the invention, the braking power provides a unidirectional force opposing lowering of the weight. The illustrated embodiment discloses an endless loop of rope engaged by the user and the brake to transmit the input power and the braking power to a differential member.

The differential member is coupled to the connector member and receives the input power from the input mechanism and the braking power from the brake. The differential member sums the input power and the braking power, and applies the resultant to the connector member so that if the resultant is positive the connector member is moved in a second direction generally opposite the first direction, and if the resultant is negative the connector member is moved in the first direction. In the illustrated embodiment of the invention, the resultant is applied to the weight so that if the resultant is positive the weight is lifted, and if the resultant is negative the weight is lowered.

The flexible member interconnects the input mechanism, the brake mechanism and the differential member to transmit the input power and the braking power to the differential member. In the illustrated embodiment of the invention, the differential member includes a movable trolley with the weight coupled thereto so that movement of the trolley in a first direction lifts the weight, and movement of the trolley in a second direction lowers the weight. The trolley is engaged by the flexible member to produce movement of the trolley in the first direction if the resultant is positive, and to produce movement of the trolley in the second direction if the resultant is negative.

The apparatus further includes a startup brake applying additional braking force supplementing the brake until the connector member is moved in the second direction a predetermined distance. In the illustrated embodiment, the weight is in a lowered startup or rest position when the apparatus is not in use, and the additional braking force is supplied until the weight is lifted from the rest position to a raised position. The startup brake gradually releases the supplemental braking power as the weight is lifted toward the raised position.

In the illustrated embodiment, the weight is a stack of individual weights selectively locked together. This permits the user to selectively vary the number of individual weights comprising the weight coupled to the differential member.

In the illustrated embodiment, the flexible member or rope engages a rotatable member comprising a portion of the brake so that the flexible member is fed to the differential member at a rate determined by the rotational speed of the rotatable member. In the illustrated embodiment, the rotatable member is a drum, and the brake further includes a friction belt frictionally engaging the drum. The braking power applied by the brake is selected by the user. In the illustrated embodiment, means are provided for the user to lock selected ones of the individual weights in the stack together to form the weight, with the ones of the individual weights not selected by the user being attached to the brake. The magnitude of the braking power applied by the brake is dependent upon the number of individual weights attached to the brake.

The present invention further includes a method of exercising using the above exercise apparatus. The method includes providing a vertically movable weight, providing an input mechanism engageable by the user, and applying a positive input power to lift the weight in response to the user input of a unidirectional force at a user-selected velocity applied to the input mechanism or differential. The method further includes providing a brake, and applying with the brake a negative braking power with a unidirectional force opposing lowering of the weight. The method also includes providing a differential member coupled to the weight, receiving the input power from the input mechanism and the braking power from the brake, and summing the input power and the braking power using the differential member. Finally, the method includes applying the resultant of the summing to the weight to lift the weight if the resultant is positive, and to lower the weight if the resultant is negative. Other steps of the method include applying additional braking force supplementing the brake until the weight is lifted from a rest position to a raised position, and gradually reducing the supplemental braking force as the weight is lifted toward the raised position.

Other features and advantages of the invention will become apparent from the following detailed description, taken in conjunction with the accompanying drawings.

BRIEF DESCRIPTION OF THE DRAWINGS

For a fuller understanding of the nature and objects of the invention, reference should be had to the following detailed description taken in connection with the accompanying drawing, in which.

DETAILED DESCRIPTION OF THE INVENTION

Figure 1:
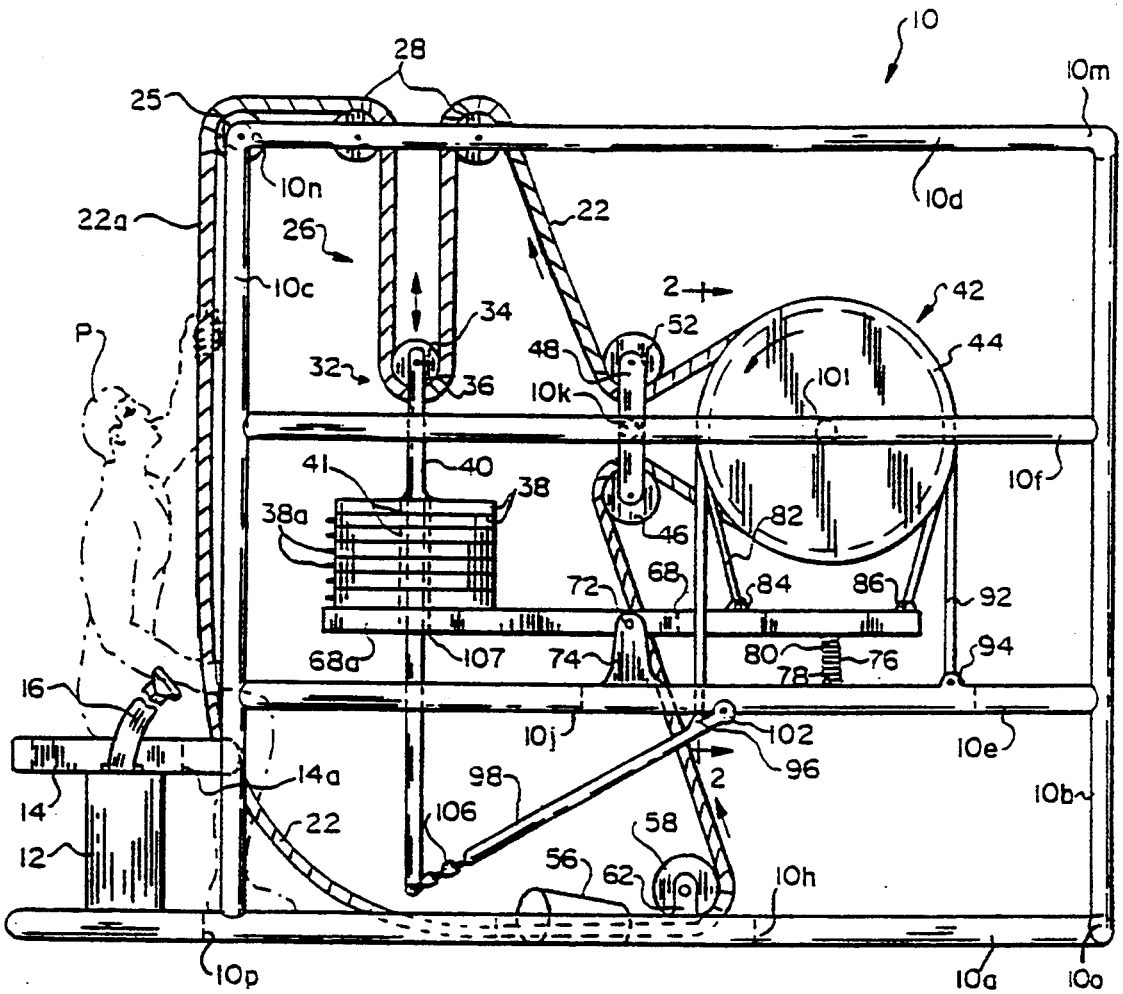
FIG. 1 is a diagrammatic view of rope climbing exercise apparatus incorporating my invention.

Referring to FIG. 1 of the drawing, my exercise apparatus includes a support or frame 10 comprising a pair of upstanding side-by-side, generally rectangular frames, each frame including a horizontal bottom frame member 10*a*, a pair of vertical front and rear frame members 10*b* and 10*c*, and a top horizontal frame member 10*d*. Additional intermediate horizontal frame members 10*e* and 10*f* extend between the front and rear frame members 10*b* and 10*c* to provide reinforcement and support sites for the various apparatus components to be described presently.

The two side frames are maintained in spaced-apart relation by a lateral strap 10*h* connected between bottom frame members 10*a* and another lateral strap 10*j* extending between frame members 10*e*. There are also lateral tubular frame members 10*k* and 10*l* extending between frame members 10*f*. Additional lateral frame members 10*m* and 10*n* extend between frame members 10*d* at the upper corners of frame 10.

Preferably, the bottom frame members 10*a* extend behind the rear frame members 10*c*, with the ends of those frames being connected by a lateral strap 10*p* which supports a pedestal 12 and a seat 14 mounted to the top of the pedestal. When using the apparatus, one may sit on the seat 14 facing frame 10 as shown at P in FIG. 1. Preferably, the seat includes a seat belt 16 to enable one to secure himself to the seat to maximize the amount of rope-pulling force that can be exerted when exercising.

The part of the apparatus that is acted upon directly by the user P is a length of strong rope 22 formed as an endless loop in a generally vertical plane within the apparatus frame 10. The rope includes a stretch or segment 22*a* which extends down vertically just in front of seat 14 from a pulley 25 rotatively mounted between frame members 10*d* at the upper left corner of frame 10. Preferably, the seat has a notch 14*a* at its forward end to provide clearance for the rope segment 22*a* so that the segment can pass close to the chest of the user P sitting on seat 14 as shown in FIG. 1.

When the user pulls down on the rope segment 22*a* to input a unidirectional force at a user-selected velocity, rope is drawn over pulley 25 from a rope accumulator or differential shown generally at 26. This user input exercise force at the user-selected velocity produces a positive input power. The accumulator comprises a pair of spaced-apart fixed pulleys 28 rotatively mounted between the frame top members 10*d* and a vertically movable dancer trolley 32 suspended below the fixed pulleys. The dancer trolley includes a pulley 34 rotatively mounted between the legs of a generally U-shaped strap 36. Dancer trolley 32 is force-loaded downward by a stack of weights or resistance member 38. The uppermost weight is connected to a rod or connector member 40 whose upper end is connected to the bridge portion of the strap 36. The rod 40 extends downward through central holes 41 in the weights so that its lower end is located well below the weight stack. Preferably, each of the individual weights 38 weighs approximately the same amount and is of the lockable variety found in many conventional exercise machines. That is, the weight includes locking mechanisms so that each individual weight can be selectively locked together with others of the individual weights using the levers or pins 38*a* projecting from the edges of the weights. Thus, by actuating the lever 38*a* on a selected one of the weights, all of the weights below the selected one will be released. Alternatively, graduated weights in which each successive weight 38 weighs more than the one above it may be used.

As will be apparent from the foregoing, if dancer trolley 32 is raised, the uppermost weight 38 permanently connected to rod 40 will be raised along with the dancer trolley, as will all of the underlying weights 38 locked to that weight. For example, if the lever 38*a* on that uppermost weight 38 is moved to its unlocking position, only that uppermost, and presumably the lightest weight will be raised when the dancer trolley 32 moves upwards.

Rope 22 passes over the stationary pulleys 28 and under the dancer pulley 34 so that the accumulator can store a variable length of quantity of rope, the amount of which varies depending upon the vertical position of the dancer trolley 32. That is, as the dancer trolley moves upwards, less rope is stored in the accumulator 26. Conversely, when the dancer trolley is near the bottom of its vertical motion, the accumulator 26 contains a greater quantity of rope. The vertical position of the dancer trolley 32 may vary within a range from its maximum storage position (as shown in FIG. 1) to a position of equilibrium, as described below.

Figure 2:
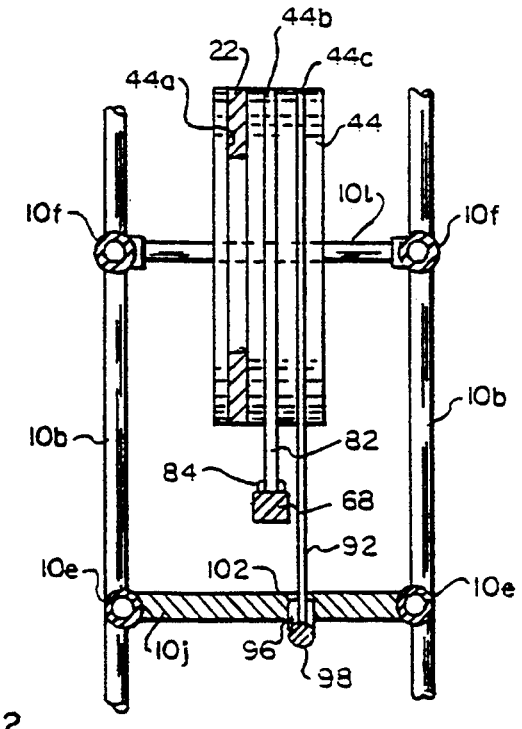
FIG. 2 is a sectional view taken along line 2—2 of FIG. 1.

A drag mechanism 42 comprises a relatively large diameter drum or wheel 44 rotatively mounted to transverse frame member 10*l*. As best shown in FIG. 2, drum 44 is formed with three peripheral grooves 44*a*, 44*b* and 44*c* spaced apart axially along the drum. Thus, the drum is equivalent, in effect, to three axially-connected-together pulleys. Rope 22 is guided into the leftmost drum groove 44*a* by a guide pulley 46 rotatively connected between the lower ends of a pair of vertical straps 48 mounted to the frame transverse frame member 10*k*. The rope 22 is guided from the drum groove 44*a* to the nearest fixed pulley 28 of accumulator 26 by guide pulley 52 rotatively mounted between the upper ends of straps 48.

When the user pulls down on the rope segment 22*a*, the tension on the rope tends to turn the drum 44 counterclockwise as viewed in FIG. 1 so that the rope is drawn onto the drum by way of the guide pulley 46. That rope requirement is satisfied by rope which accumulates at the bottom of the loop and which is guided by a conical guide 56 mounted to the transverse strap 10*h* onto a guide pulley 58 rotatively mounted to an ear 62 projecting up from strap 10*h*. Pulley 58 redirects the rope to the guide pulley 46 so that the rope being pulled by user P forms a continuous loop as it passes through the accumulator 26 and drag mechanism 42.

Still referring to FIG. 1, positioned directly under accumulator 26, guide pulleys 46 and 52 and drum 44 is a teeterboard 68. The teeterboard is connected by pivots 72 at its transverse centerline between a pair of laterally spaced-apart tabs 74 projecting up from the frame transverse strap 10*j*. Preferably, pivots 74 are located more or less directly below the pivotal connections of the guide pulleys 46 and 52 to strap 48. The rear or left-hand end segment of teeterboard 68 has an enlargement 68*a* with a size comparable to that of weights 38 so that the stack of weights can rest on enlargement 68*a* where it tends to tilt the teeterboard counterclockwise as viewed in FIG. 1. The downward force of the weights 38 on the teeterboard is offset by a strong spring 76 connected between an eye 78 on the frame transverse strap 10*j* and an eye 80 near the opposite end of the teeterboard, preferably at a location thereon directly below the pivot axis of drum 44. Preferably, the spring 76 acts to maintain the frictional braking force applied to the drum 44 by belt 82 proportional to the weight lifted from the stack of weights 38.

As shown in FIGS. 1 and 2, an inextensible belt or strap 82 is engaged around drum 44 in its middle groove 44*b* with the opposite ends of that strap being connected to the teeterboard 68 by eye connections 84 and 86 spaced equally therealong from the spring eye 80. Thus, it will be appreciated that when the teeterboard 68 is tilted clockwise as viewed in FIG. 1 due to the force applied by spring 76 and a reduced weight on the teeterboard enlargement 68*a*, the tension on belt 82 will be increased so that the belt applies increased frictional drag to drum 44. Conversely, if the teeterboard 68 tilts counterclockwise in response to a greater weight on its enlargement 68*a*, the drag exerted by the belt 82 on the drum 44 will be reduced in proportion to the greater weight remaining on the enlargement 68*a*. The frictional drag produces a negative braking power with a unidirectional force opposing the lowering of the weight 38.

The third groove 44*c* of drum 44 accommodates another inextensible belt 92, one end of which is secured to an eye 94 projecting up from the frame transverse strip 10*j* and the other end of which is connected to an eye 96 on a lever arm 98 whose upper end is connected by a pivot 102 to the frame strap 10*j*. The lever 98 extends down below the teeterboard enlargement 68*a* and its lower end is connected by a flexible chain 106 to the lower end of rod 40, the rod extending below enlargement 68*a* through a clearance hole 107 therein. This forms a startup brake to apply additional braking force until the weight 38 is sufficiently lifted from its rest position to a raised position.

It will be seen from the foregoing that when the accumulator dancer trolley 32 is in its maximum storage position, at which there is a maximum amount of rope stored in accumulator 26, the lever arm 98 will exert a maximum amount of tension on the belt 92 so that the belt exerts maximum drag on the drum 44. On the other hand, when the dancer trolley 32 is raised because there is sufficient force applied to the rope segment 22*a*, lever arm 98 swings upwardly thereby reducing the tension on belt 92. As the dancer trolley 32 rises and tension is gradually reduced on belt 92, the dancer 32 eventually reaches an equilibrium position where power is balanced between the user-input power and the braking power.

As will be apparent, the differential or accumulator 26 receives the user-input power and the braking power from the brake, and sums the input power and the braking power. The resultant is applied to the weight 38 so that if the resultant is positive the weight is lifted, and if the resultant is negative the weight is lowered.

Preferably, the exercise apparatus is arranged so that the drum 44 will not turn unless the user, by pulling on rope segment 22*a*, raises the dancer trolley 32 enough to swing lever arm 98 up so as to reduce the tension on belt 92. Since the accumulator 26 forms a pulley system with a mechanical advantage of two, this means that the user must exert a downward force on the rope segment 22*a* that is at least one-half the vertical load on the dancer trolley 32, i.e., the force exerted by the weights 38 connected to the dancer. So long as the user exerts this requisite pulling force on the rope segment 22*a*, belt 92 will exert minimal drag on drum 44 enabling the drum to rotate and replenish the accumulator 26 with rope. The rate at which the moving drum will be turned by the pulling force depends on the drag exerted on the drum by the belt 82. That depends, in turn, on the amount of weight which is lifted when the user pulls down on the rope segment 22*a* in order to raise the dancer trolley as aforesaid, or more accurately, the amount of weight not lifted and which, therefore, remains on the teeterboard.

If, for example, only the topmost weight 38 is connected to the dancer trolley 32, only a small pulling force on the rope will be required to raise the dancer trolley 32 enough to untension belt 92 and permit rotation of the drum 42. Since the rest of the weights 38 remain on the teeterboard, the drag exerted on the drum by belt 82 will be a minimum. Resultantly, the user's arm and back muscles are subjected to substantially constant dynamic tension, albeit of a relatively small magnitude because, in this example, he is only lifting the topmost weight 38 in the apparatus. In other words, with only a single weight 38 being connected to the dancer trolley, the user exerts only a small pulling force on the rope.

The degree of difficulty can be increased by force-loading the dancer trolley 32 with a greater number of the weights 38. This means that when the user pulls down on the rope segment 22*a*, he will have to exert more force in order to lift the dancer trolley 32 enough to untension belt 92 so that drum 44 can rotate. In addition, since fewer weights 38 remain on the teeterboard enlargement 68*a* to offset the pulling action thereon by spring 76, he must exert additional pulling force on the rope segment 22*a* in order to raise the dancer trolley 32 from its maximum storage position. The user must pull down on the rope with a greater force than in the first example because of the additional number of weights 38.

As will be seen from the foregoing, my exercise apparatus provides an effective and efficient way for one to exercise the arm and back muscles in the same way as would occur if the user were actually climbing a rope. By using the appropriate number and sizes of weights 38, my exercise apparatus can even enable a user to pull down rope segment 22*a* hand-over-hand with a force equal to his own weight or even more as he would to do if he were hoisting himself up on a rope. Preferably, to do this he would secure himself to seat 14 by using seat belt 16. In addition, my apparatus allows a user to exercise exerting a force less than his body weight by simple adjustment of the weights 38.

It should also be appreciated that the apparatus is quite compact so that it only occupies a small amount of floor space in an exercise room, health club or the like. Also, since it is made up of a relatively small number of relatively inexpensive rugged parts, the apparatus should have a long useful life.

It will thus be seen that the objects set forth above, among those made apparent from the preceding description, are efficiently attained. Also, certain changes may be made in the above construction without departing from the spirit and scope of the invention. For example, the various components of the apparatus may be rearranged so that the rope segment 22*a* is oriented horizontally enabling the person exercising to pull on the rope horizontally as he would do if he were engaging in a game of tug-of-war. Therefore, it is intended that all matter contained in the above description or shown in the accompanying drawing shall be interpreted as illustrative and not in a limiting sense.

It is also to be understood that the following claims are intended to cover all of the generic and specific features of the invention herein described.

I claim:

1. An exercise apparatus, comprising:

a vertically movable weight;

an input mechanism engaged by the user to input a unidirectional force at a user-selected velocity to apply a positive input power to lift the weight;

a brake applying a negative braking power with a unidirectional force opposing lowering of the weight; and a differential member coupled to the weight and receiving the input power from the input mechanism and the braking power from the brake, the differential member summing the input power and the braking power and applying the resultant to the weight so that if the resultant is positive the weight is lifted, and if the resultant is negative the weight is lowered.

2. The apparatus of claim 1, further including a flexible member interconnecting the input mechanism, the brake and the differential member to transmit the input power and the braking power to the differential member.

3. The apparatus of claim 2 wherein the differential member includes a movable trolley with the weight coupled thereto so that movement of the trolley in a first direction lifts the weight and movement of the trolley in a second direction lowers the weight, the trolley being engaged by the flexible member to produce movement of the trolley in the first direction if the resultant is positive, and to produce movement of the trolley in the second direction if the resultant is negative.

4. The apparatus of claim 1 wherein the weight is in a lowered startup position when the apparatus is not in use, and the apparatus further includes a startup brake applying additional braking force supplementing the brake until the weight is lifted from the startup position to a raised position.

5. The apparatus of claim 4 wherein the startup brake gradually reduces the supplemental braking force as the weight is lifted toward the raised position.

6. The apparatus of claim 1 wherein the input mechanism includes a rope pulled by the user.

7. The apparatus of claim 1 wherein the input mechanism includes a flexible member to which the unidirectional input force is applied.

8. The apparatus of claim 1 wherein the input mechanism includes an endless loop of rope engaged by the user and the brake to transmit the input power and the braking power to the differential member.

9. The apparatus of claim 1 wherein the weight is a stack of individual weights selectively locked together to permit the user to selectively vary the number of individual weights comprising the weight coupled to the differential member.

10. The apparatus of claim 1, further including a flexible member extending between the brake and the differential member to transmit the braking power therebetween, and wherein the brake includes a rotatable member around which the flexible member is engaged so that the flexible member is fed to the differential member at a rate determined by the rotational speed of the rotatable member.

11. The apparatus of claim 10 wherein the rotatable member is a drum and the brake further includes a friction belt frictionally engaging the drum.

12. The apparatus of claim 10 wherein the braking power applied by the brake is selectively adjustable by the user.

13. The apparatus of claim 12, further including an adjustment member selectively adjustable by the user to select the braking power applied by the brake.

14. The apparatus of claim 10, further including a stack of individual weights and means for the user to lock selected ones of the individual weights together to form the weight, the ones of the individual weights not selected by the user being attached to the brake and the magnitude of the braking power applied by the brake being dependent upon the number of the individual weights attached to the brake.

15. The apparatus of claim 1 wherein the braking power applied by the brake is selectively adjustable by the user.

16. The apparatus of claim 2 wherein the flexible member has first, second and third lengthwise portions, the first portion of the flexible member extending between the brake and the input mechanism, the differential member including a first rotatable member suspended on the first portion of the flexible member for lifting and lowering vertical movement of the first rotatable member in response to shortening and lengthening of the first portion of the flexible member, the weight being coupled to the first rotatable member for vertical movement therewith, the brake including a second rotatable member around which the second portion of the flexible member is engaged with the negative braking power being applied to the second portion of the flexible member, and the input mechanism including a third rotatable member around which the third portion of the flexible member is engaged with the positive input power being applied to the third portion of the flexible member, the flexible member transmitting the positive input power and the negative braking power to the differential member while being moved in a unidirection along a path of movement between the input mechanism and the brake.

17. The apparatus of claim 16 wherein the flexible member further includes a fourth lengthwise portion extending between the second and third portions of the flexible member such that the flexible member forms an endless loop.

18. The apparatus of claim 2 wherein the flexible member has first, second and third lengthwise portions, the first portion of the flexible member extending between the brake and the input mechanism, the differential member including a rotatable member suspended on the first portion of the flexible member for lifting and lowering vertical movement of the first rotatable member in response to shortening and lengthening of the first portion of the flexible member, the weight being coupled to the first rotatable member for vertical movement therewith, the brake applying the negative braking power to the second portion of the flexible member, and the input mechanism applying the positive input power to the third portion of the flexible member.

19. An exercise apparatus, comprising:

a vertically movable weight;

an input mechanism engaged by the user to input an exercise force at a velocity to apply a positive input power;

a brake applying a negative braking power; and a differential member coupled to the weight and receiving the input power from the input mechanism and the braking power from the brake, the differential member summing the input power and the braking power and applying the resultant to the weight so that if the resultant is positive the weight is lifted, and if the resultant is negative the weight is lowered.

20. The apparatus of claim 16, further including a flexible member interconnecting the input mechanism, the brake and the differential member to transmit the input power and the braking power to the differential member.

21. The apparatus of claim 19 wherein the weight is in a lowered startup position when the apparatus is not in use, and the apparatus further includes a startup brake applying additional braking force supplementing the brake until the weight is lifted from the startup position to a raised position.

22. The apparatus of claim 21 wherein the startup brake gradually reduces the supplemental braking force as the weight is lifted toward the raised position.

23. The apparatus of claim 19 wherein the input mechanism includes a flexible member to which the exercise force is applied.

24. The apparatus of claim 19 wherein the weight is a stack of individual weights selectively locked together to permit the user to selectively vary the number of individual weights comprising the weight coupled to the differential member.

25. The apparatus of claim 19, further including a flexible member extending between the brake and the differential member to transmit the braking power therebetween, and wherein the brake includes a rotatable member around which the flexible member is engaged so that the flexible member is fed to the differential member at a rate determined by the rotational speed of the rotatable member.

26. The apparatus of claim 25 wherein the braking power applied by the brake is selected by the user.

27. The apparatus of claim 26, further including an adjustment member selectively adjustable by the user to select the braking power applied by the brake.

28. The apparatus of claim 25, further including a stack of individual weights and means for the user to lock selected ones of the individual weights together to form the weight, the ones of the individual weights not selected by the user being attached to the brake and the magnitude of the braking power applied by the brake being dependent upon the number of the individual weights attached to the brake.

29. The apparatus of claim 19 wherein the braking power applied by the brake is selectively adjustable by the user.

30. The apparatus of claim 20 wherein the flexible member has first, second and third lengthwise portions, the first portion of the flexible member extending between the brake and the input mechanism, the differential member including a first rotatable member suspended on the first portion of the flexible member for lifting and lowering vertical movement of the first rotatable member in response to shortening and lengthening of the first portion of the flexible member, the weight being coupled to the first rotatable member for vertical movement therewith, the brake including a second rotatable member around which the second portion of the flexible member is engaged with the negative braking power being applied to the second portion of the flexible member, and the input mechanism including a third rotatable member around which the third portion of the flexible member is engaged with the positive input power being applied to the third portion of the flexible member, the flexible member transmitting the positive input power and the negative braking power to the differential member while being moved in a unidirection along a path of movement between the input mechanism and the brake.

31. The apparatus of claim 30 wherein the flexible member further includes a fourth lengthwise portion extending between the second and third portions of the flexible member such that the flexible member forms an endless loop.

32. The apparatus of claim 20 wherein the flexible member has first, second and third lengthwise portions, the first portion of the flexible member extending between the brake and the input mechanism, the differential member including a rotatable member suspended on the first portion of the flexible member for lifting and lowering vertical movement of the first rotatable member in response to shortening and lengthening of the first portion of the flexible member, the weight being coupled to the first rotatable member for vertical movement therewith, the brake applying the negative braking power to the second portion of the flexible member, and the input mechanism applying the positive input power to the third portion of the flexible member.

33. An exercise apparatus, comprising:

a connector member;

a resistance member applying a resistance force in a first direction to the connector member;

an input mechanism engaged by the user to input a unidirectional force in a second direction generally opposite the first direction at a user-selected velocity to apply a positive input power;

a brake applying a negative braking power with a unidirectional force in the second direction; and a differential member coupled to the connector member and receiving the input power from the input mechanism and the braking power from the brake, the differential member summing the input power and the braking power and applying the resultant to the connector member so that if the resultant is positive the connector member is moved in the second direction, and if the resultant is negative the connector member is moved in the first direction.

34. The apparatus of claim 33, further including a flexible member interconnecting the input mechanism, the brake and the differential member to transmit the input power and the braking power to the differential member.

35. The apparatus of claim 34 wherein the differential member includes a movable trolley with the resistance member coupled thereto, the trolley being engaged by the flexible member to produce movement of the trolley in one direction if the resultant is positive, and to produce movement of the trolley in an opposite direction if the resultant is negative.

36. The apparatus of claim 33, further including a startup brake applying additional braking force supplementing the brake until the connector member is moved in the second direction a predetermined distance.

37. The apparatus of claim 36 wherein the startup brake gradually reduces the supplemental braking force as the connector member is moved over the predetermined distance.

38. The apparatus of claim 33 wherein the input mechanism includes a rope pulled by the user.

39. The apparatus of claim 33 wherein the input mechanism includes a flexible member to which the unidirectional input force is applied.

40. The apparatus of claim 33 wherein the input mechanism includes an endless loop of rope engaged by the user and the brake to transmit the input power and the braking power to the differential member.

41. The apparatus of claim 33, further including a flexible member extending between the brake and the differential member to transmit the braking power therebetween, and wherein the brake includes a rotatable member around which the flexible member is engaged so that the flexible member is fed to the differential member at a rate determined by the rotational speed of the rotatable member.

42. The apparatus of claim 41 wherein the rotatable member is a drum and the brake further includes a friction belt frictionally engaging the drum.

43. The apparatus of claim 41 wherein the braking power applied by the brake is selected by the user.

44. The apparatus of claim 43, further including an adjustment member selectively adjustable by the user to select the braking power applied by the brake.

45. The apparatus of claim 33 wherein the resistance force applied by the resistance member is selected by the user.

46. The apparatus of claim 45 wherein the magnitude of the braking power applied by the brake being dependent upon the resistance force selected by the user.

47. The apparatus of claim 34 wherein the flexible member has first, second and third lengthwise portions, the first portion of the flexible member extending between the brake and the input mechanism, the differential member including a first rotatable member around which the first portion of the flexible member is engaged for reciprocal movement of the first rotatable member in response to shortening and lengthening of the first portion of the flexible member, the connector member being coupled to the first rotatable member for movement therewith, the brake including a second rotatable member around which the second portion of the flexible member is engaged with the negative braking power being applied to the second portion of the flexible member, and the input mechanism including a third rotatable member around which the third portion of the flexible member is engaged with the positive input power being applied to the third portion of the flexible member, the flexible member transmitting the positive input power and the negative braking power to the differential member while being moved in a unidirection along a path of movement between the input mechanism and the brake.

48. The apparatus of claim 47 wherein the flexible member further includes a fourth lengthwise portion extending between the second and third portions of the flexible member such that the flexible member forms an endless loop.

49. The apparatus of claim 34 wherein the flexible member has first, second and third lengthwise portions, the first portion of the flexible member extending between the brake mad the input mechanism, the differential member including a rotatable member around which the first portion of the flexible member is engaged for reciprocal movement of the first rotatable member in response to shortening and lengthening of the first portion of the flexible member, the connector member being coupled to the first rotatable member for movement therewith, the brake applying the negative braking power to the second portion of the flexible member, and the input mechanism applying the positive input power to the third portion of the flexible member.

50. An exercise apparatus, comprising:

a connector member;

a resistance member applying a resistance force in a first direction to the connector member;

an input mechanism engaged by the user to input an exercise force at a velocity to apply a positive input power;

a brake applying a negative braking power; and a differential member coupled to the connector member and receiving the input power from the input mechanism and the braking power from the brake, the differential member summing the input power and the braking power and applying the resultant to the connector member so that if the resultant is positive the connector member is moved in a second direction generally opposite the first direction, and if the resultant is negative the connector member is moved in the first direction.

51. The apparatus of claim 50, further including a flexible member interconnecting the input mechanism, the brake and the differential member to transmit the input power and the braking power to the differential member.

52. The apparatus of claim 50, further including a startup brake applying additional braking force supplementing the brake until the connector member is moved in the second direction a predetermined distance.

53. The apparatus of claim 52 wherein the startup brake gradually reduces the supplemental braking force as the connector member is moved over the predetermined distance.

54. The apparatus of claim 50 wherein the input mechanism includes a flexible member to which the exercise force is applied.

55. The apparatus of claim 50, further including a flexible member extending between the brake and the differential member to transmit the braking power therebetween, and wherein the brake includes a rotatable member around which the flexible member is engaged so that the flexible member is fed to the differential member at a rate determined by the rotational speed of the rotatable member.

56. The apparatus of claim 55 wherein the braking power applied by the brake is selected by the user.

57. The apparatus of claim 56, further including an adjustment member selectively adjustable by the user to select the braking power applied by the brake.

58. The apparatus of claim 50 wherein the resistance force applied by the resistance member is selected by the user.

59. The apparatus of claim 51 wherein the flexible member has first, second and third lengthwise portions, the first portion of the flexible member extending between the brake and the input mechanism, the differential member including a first rotatable member around which the first portion of the flexible member is engaged for reciprocal movement of the first rotatable member in response to shortening and lengthening of the first portion of the flexible member, the connector member being coupled to the first rotatable member for movement therewith, the brake including a second rotatable member around which the second portion of the flexible member is engaged with the negative braking power being applied to the second portion of the flexible member, and the input mechanism including a third rotatable member around which the third portion of the flexible member is engaged with the positive input power being applied to the third portion of the flexible member, the flexible member transmitting the positive input power and the negative braking power to the differential member while being moved in a unidirection along a path of movement between the input mechanism and the brake.

60. The apparatus of claim 59 wherein the flexible member further includes a fourth lengthwise portion extending between the second and third portions of the flexible member such that the flexible member forms an endless loop.

61. The apparatus of claim 51 wherein the flexible member has first, second and third lengthwise portions, the first portion of the flexible member extending between the brake and the input mechanism, the differential member including a rotatable member around which the first portion of the flexible member is engaged for reciprocal movement of the first rotatable member in response to shortening and lengthening of the first portion of the flexible member, the connector member being coupled to the first rotatable member for movement therewith, the brake applying the negative braking power to the second portion of the flexible member, and the input mechanism applying the positive input power to the third portion of the flexible member.

* * * * *

UNITED STATES PATENT AND TRADEMARK OFFICE

CERTIFICATE OF CORRECTION

PATENT NO. : 5,380,258
DATED : January 10, 1995
INVENTOR(S) : Peter J. Hawley, Jr.

It is certified that error appears in the above-indentified patent and that said Letters Patent is hereby corrected as shown below:

In column 14, claim 49, line 4, please delete "mad" and insert therefor--and--.

Signed and Sealed this

Twenty-fifth Day of June, 1996

*Attest:*

Bruce Lehman

BRUCE LEHMAN

*Attesting Officer*

*Commissioner of Patents and Trademarks*